US005370263A

United States Patent [19]

Brown

[11] Patent Number: 5,370,263

[45] Date of Patent: Dec. 6, 1994

[54] LADDER CADDY

[75] Inventor: Harry L. Brown, 2224 Beech St., Virginia Beach, Va. 23451

[73] Assignees: Harry L. Brown; Lyle L. Tatroe, Virginia Beach, Va.

[21] Appl. No.: 172,159

[22] Filed: Dec. 23, 1993

Related U.S. Application Data

[63] Continuation-in-part of Ser. No. 839,495, Feb. 20, 1992, and a continuation-in-part of Ser. No. 777,105, Oct. 16, 1991.

[51] Int. Cl.[5] ..... B65D 25/28

[52] U.S. Cl. ..... 220/751; 220/756; 220/757; 220/761; 220/762; 220/770; 220/775; 220/776; 220/555; 206/373; 248/210

[58] Field of Search ..... 220/751, 756, 757, 758, 220/761, 762, 770, 775, 776, 555; 206/373; 248/210, 238

[56] References Cited

U.S. PATENT DOCUMENTS

| | | | |
|---|---|---|---|
| D. 259,099 | 5/1981 | Davis . | |
| D. 295,106 | 4/1981 | Hays et al. . | |
| D. 316,171 | 4/1991 | Chatham et al. . | |
| 1,593,366 | 7/1926 | Singer | 248/210 X |
| 2,308,180 | 1/1943 | Larsen et al. | 248/238 X |
| 2,444,096 | 6/1948 | Faust | 248/238 X |
| 2,678,243 | 5/1954 | Masse | 248/238 X |
| 4,058,210 | 11/1977 | Mitchell . | |
| 4,550,828 | 11/1985 | Baldwin et al. . | |
| 4,653,713 | 3/1987 | Hamilton . | |
| 4,706,918 | 11/1987 | Wilson . | |
| 4,730,802 | 3/1988 | Chatham . | |
| 5,275,256 | 1/1994 | Ellzey | 248/238 X |

FOREIGN PATENT DOCUMENTS

| | | | |
|---|---|---|---|
| 197158 | 5/1923 | United Kingdom | 248/210 |
| 336271 | 10/1930 | United Kingdom | 248/210 |

*Primary Examiner*—Allan N. Shoap
*Assistant Examiner*—Stephen Cronin
*Attorney, Agent, or Firm*—Griffin, Butler, Whisenhunt & Kurtossy

[57] ABSTRACT

A ladder caddy (10) includes a rigid tray (12) and a ladder-engaging handle (14)which together define a generally rectangular mounting opening (80) positioned laterally adjacent a mounting side (38) of the tray. The mounting opening is of a size and shape for receiving therein an apex portion (82) and portions of leg pairs (86, 88) of an A-frame ladder (84) when the legs are in a separated, deployed configuration, but sufficiently small that the ladder-engaging handle and the rigid tray contact the separated leg pairs of the ladder near the apex portion whereby the ladder caddy remains mounted on the A-frame ladder. The ladder-engaging handle comprises two follower arms (54*a* and *b*) which are slidably engaged in track slots (48*a* and *b*) of the rigid tray. The ladder-engaging handle also includes an outer member, or yoke bar, (60) which is rotatably attached to the follower arms and which can be rotated to change the size of the mounting opening. A separate top handle (16) can be rotated between a vertical, deployed position and a horizontal, stored, position.

14 Claims, 4 Drawing Sheets

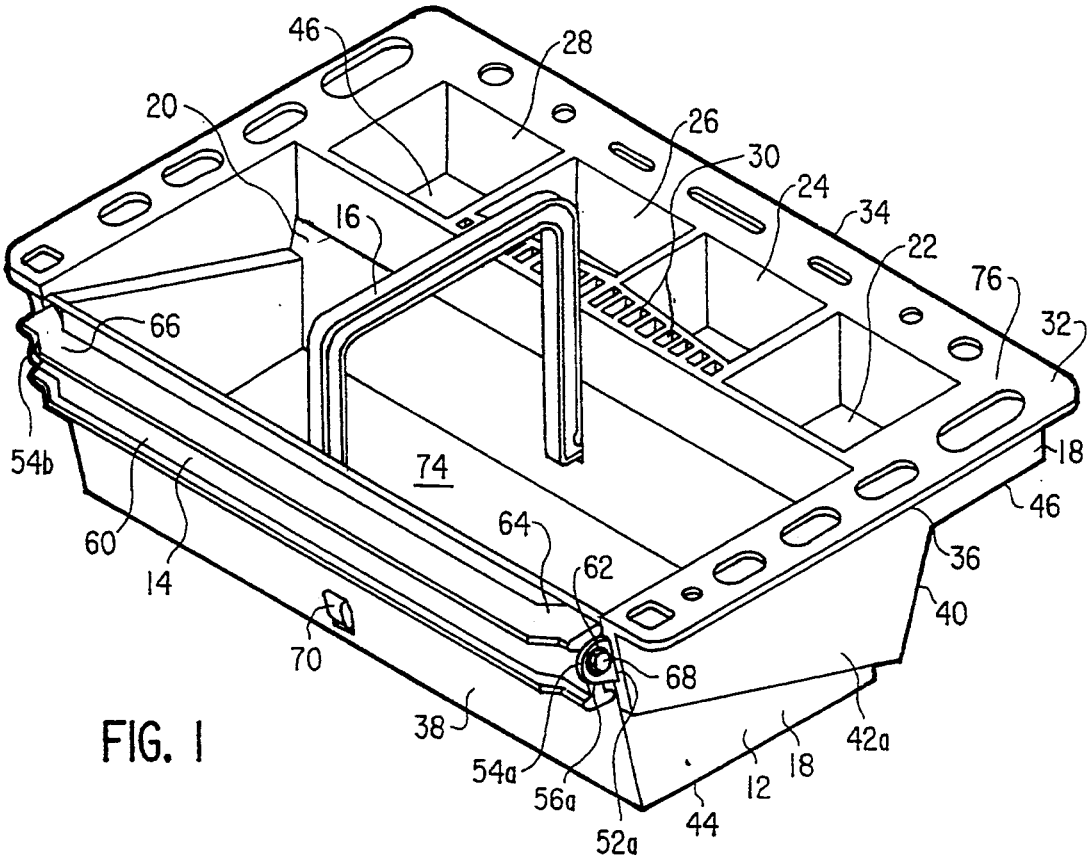
FIG. 1
FIG. 2
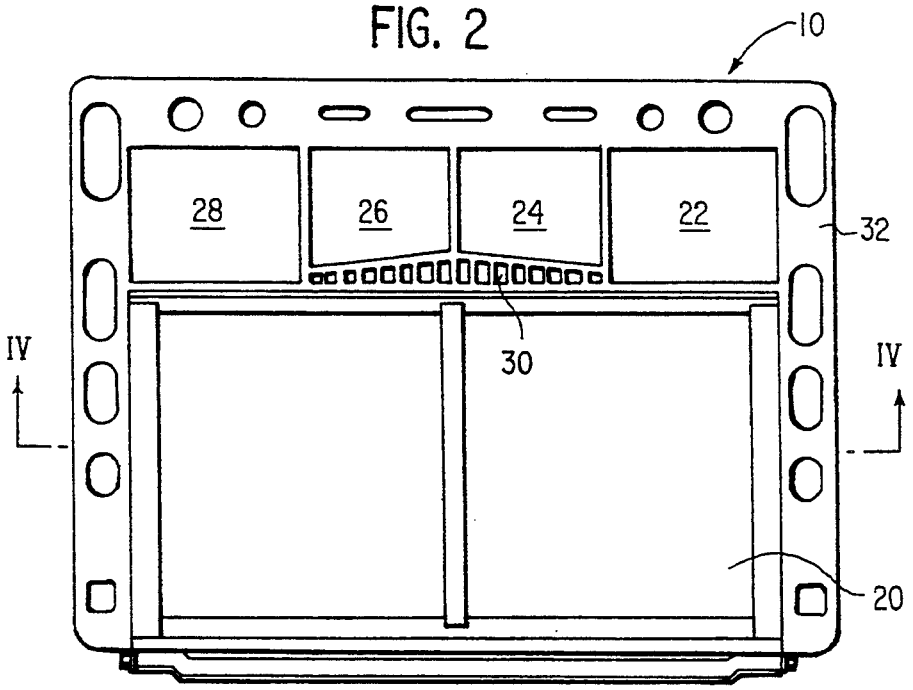

LADDER CADDY

BACKGROUND OF THE INVENTION

This application is a continuation-in-part application of U.S. application Ser. No. 07/839,495, filed Feb. 20, 1992 and Ser. No. 07/777,105, filed Oct. 16, 1991, both of which are still pending.

This invention relates generally to trays for supporting tools on A-frame ladders and more particularly to such trays which are not integral with the A-frame ladders.

A-frame ladders, that is ladders that comprise two leg pairs hinged together at an apex portion thereof with a foldable link connected between the leg pairs for preventing them from separating further than a predetermined angle, have universal usage throughout the world. Most such ladders include a top rung, or platform, at the apex portion and many such ladders also include a foldable shelf which can be folded between a stored position parallel to the leg pairs when the leg pairs are pivoted together and a deployed horizontal position when the leg pairs are pivoted apart and the ladder is used. Such foldable shelves are used for holding tools, paint and the like when their A-frame ladders are being used. Although these foldable shelves have proven to be extremely useful under certain conditions, there have also been problems associated therewith. For example, these foldable shelves make A-frame ladders more cumbersome, heavy, and difficult and expensive to construct. Also, such fold-out shelves do not hold many tools and those tools which they do hold must normally be unloaded every time their ladders are folded. Similarly, such shelves should be unloaded every time their A-frame ladders are moved to avoid the danger of tools, and the like, falling from the shelves during transportation. There are other related safety problems associated with integral fold-out shelves of A-frame ladders in that tools not only can easily fall from them during transport and otherwise, but also because users sometimes try to stand on them. In fact, there is presently a United States law that prohibits sales of A-frame ladders with integral fold-out shelves.

Thus, it is an object of this invention to provide a tray which can be mounted on an A-frame ladder which allows the ladder to be streamlined and relatively light when not in use and which is inexpensive to construct. It is another object of this invention to provide such a tray which holds tools and the like securely but which does not have to be unloaded every time an A-frame ladder on which it is used is moved. Further, it is an object of this invention to provide such a tray having an appearance of a tool chest, or tool holder, rather than a shelf, so that one is not likely to try to stand on it.

There have been a number of supports suggested in the prior art for portably supporting tools from ladders in general, and specifically from A-frame ladders; for example, see U.S. Pat. Nos. 4,653,713 to Hamilton, 4,706,918 to Wilson, and 4,730,802 to Chatham for some of these supports. A difficulty with most of these supports is that they are generally difficult to attach to ladders, cannot be securely attached to the ladders, and/or tend to destabilize ladders on which they are mounted, so that, if they were supporting heavy items, their attachment to ladders might be dangerous. Yet another problem with many such prior art supports is that ladders to which they are attached require special structures. Yet another difficulty with some such supports is that they are only to be used for very specific purposes and, in some cases, hold very few tools.

Thus, it is an object of this invention to provide a ladder caddy, or portable tray, for use with A-frame ladders which is extremely easy to securely mount on A-frame ladders, without destabilizing the ladders, and which has general use for carrying many varied tools. Similarly, it is an object of this invention to provide such a tray which, when it is not mounted on an A-frame ladder, still functions as a tool holder so that it must not be unloaded when it is detached from a ladder and so that it can normally be used as a tool box.

At the same time, it is an object of this invention to provide such a tray which is not cumbersome to use whether mounted on a ladder, or not mounted on a ladder, and which is relatively inexpensive to manufacture.

SUMMARY

According to principles of this invention, a ladder caddy comprises a rigid tray and a ladder-engaging handle, with the tray and the handle defining a generally rectangular mounting opening positioned laterally adjacent to a mounting side of the tray with the mounting opening being of a size and shape for allowing only passage therethrough of an apex portion of an A-frame ladder and portions of legs of the A-frame ladder which are pivotably attached together at the apex when the legs are in a separated, deployed, configuration.

In a preferred embodiment, the ladder-engaging handle comprises two follower arms which slidably engage track slots of the rigid tray and a rotatable outer member, or yoke bar, which is irregularly shaped so that it can be rotated to change the size of the mounting opening. A separate top handle can be directed upwardly to a deployed position or can lie in a main cavity of the tray in a stored position.

BRIEF DESCRIPTION OF THE DRAWINGS

While the invention has been particularly shown and described with reference to a preferred embodiment, it will be understood by those of ordinary skill in the art that various changes in form and detail may be made therein without departing from the spirit and scope of the invention.

FIG. 1 is a top isometric view of a ladder caddy of this invention;

FIG. 2 is a top plan view of the ladder caddy of FIG. 1;

DETAILED DESCRIPTION OF PREFERRED EMBODIMENTS

Figure 5:
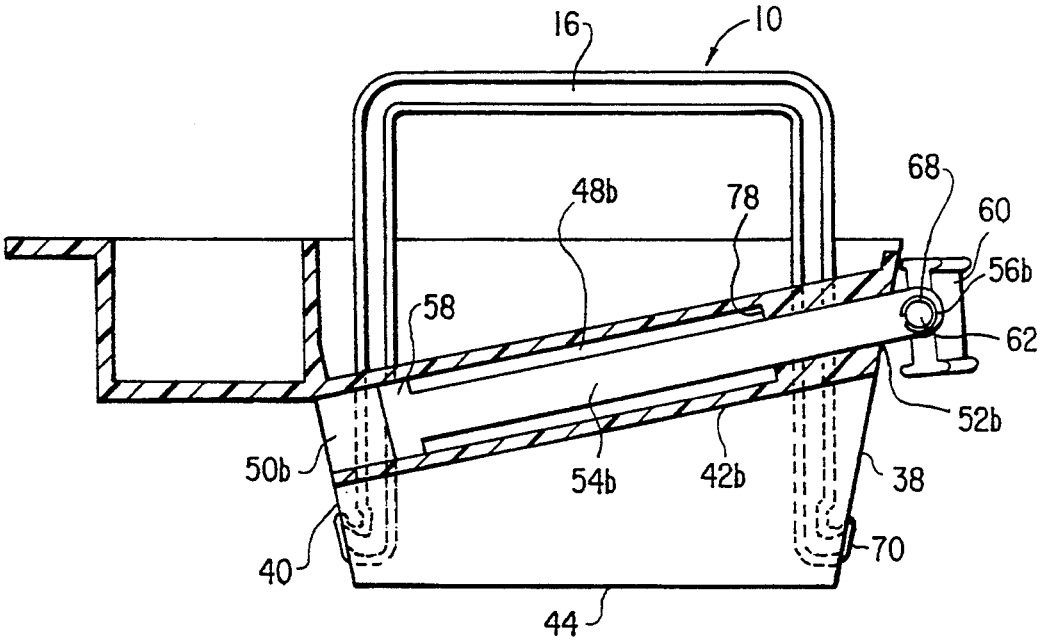
FIG. 5 is a sectional view taken on line V—V in FIG. 4.
Figure 3:
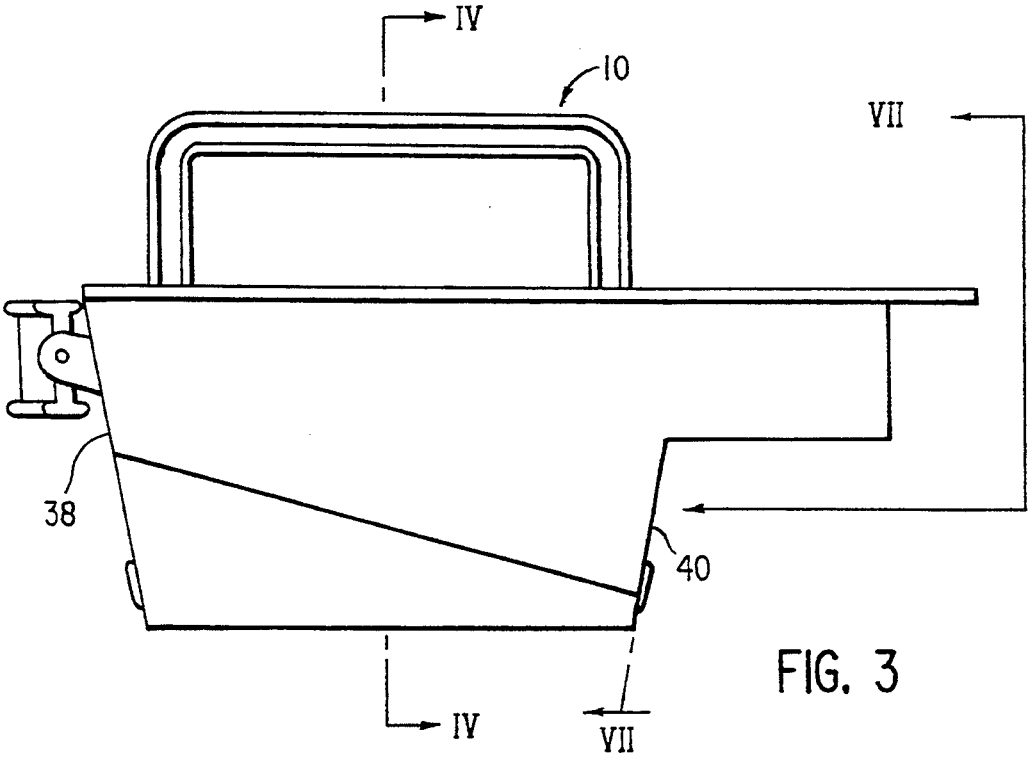
FIG. 3 is a side elevational view of the ladder caddy of FIG. 1.

A ladder caddy 10 comprises a rigid tray 12, a ladder-engaging handle 14, and a separable top handle 16.

The rigid tray 12 includes a box portion 18 for defining a main cavity 20 and numerous auxiliary cavities 22, 24, 26, 28, and 30 and a flange 32 which surrounds the top peripheries of the various cavities 20–28. The flange 32 has a length dimension along a front edge 34 of approximately 20 inches and a width dimension along a side edge 36 of almost 15 inches. On the other hand, the box portion 18 has a length dimension along a bottom of a mounting side, or a back wall, 38 and front wall 40 of approximately 15 inches and a width dimension along side walls 42*a* and *b* of 8 inches at a bottom wall 44 and approximately 13 inches where the side walls 42*a* and *b* intersect the flange 32. The box portion 18 is approximately 5½ inches deep extending from the bottom wall 44 to the top of the flange 32. As can be seen in FIG. 1, the auxiliary cavities 22–30 are not so deep (2¼ inches) as the main cavity 20 and the side walls 42*a* and *b* and an auxiliary bottom wall 46 are correspondingly shaped to accommodate this.

Figure 4:
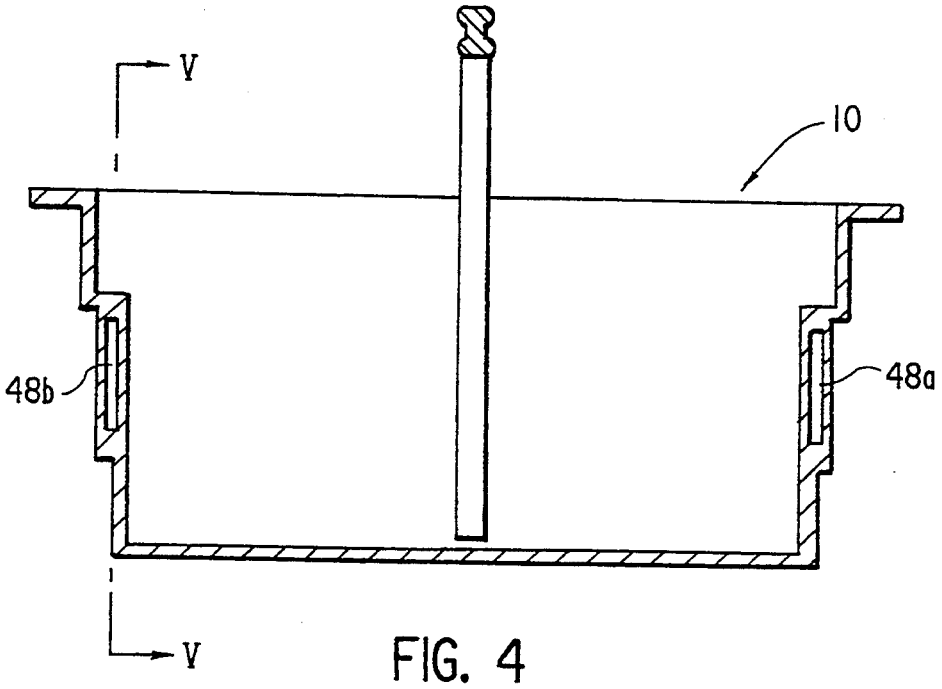
FIG. 4 is a sectional view taken on line IV—IV in FIGS. 2 and 3.

The side walls 42*a* and *b*, as can be seen in FIGS. 4 and 5, define inclined track slots 48*a* and *b* which open to the front wall 40 at front track-slot openings 50*a* and *b* and at the back wall 38 at back track-slot openings 52*a* and *b*. In this regard, as can be seen in FIG. 5, the back track-slot openings 52*a* and *b* are smaller than the front track-slot openings 50*a* and *b*.

The side, ladder-engaging handle 14 comprises two T-shaped follower arms 54*a* and *b*, a shank 56 of each of which is inserted into a respective front track-slot opening 50*a* or *b* and out through the corresponding back track-slot opening 52*a* and *b*, as depicted in FIG. 5, so that a T-portion 58 thereof also follows the shank 56 into the respective track slot 48*a* and *b* via the respective front track-slot opening 50*a* or *b*. Outer tips of the shank portions 56*a* and *b*, which extend outside of the track slots 48*a* and *b* at the mounting side, or back wall, 38 are interconnected by means of a rotatable engaging link, or yoke bar, 60 which is rotatably attached to each of the shanks 56*a* and *b* at pivot connections 62 thereof. It can be seen in most of the drawings that the yoke bar 60 has complementary bends 64 and 66 therein so that the yoke bar 60 is bowed either away from the back wall 38 or toward the back wall 38, depending on the rotational altitude of the yoke bar 60. The yoke bar 60 is approximately 16.4 inches long, not including pivot pins 68 which are molded integral therewith. Thus, follower arms 54*a* and *b* are spaced approximately 16.4 inches from one another.

Figure 7:
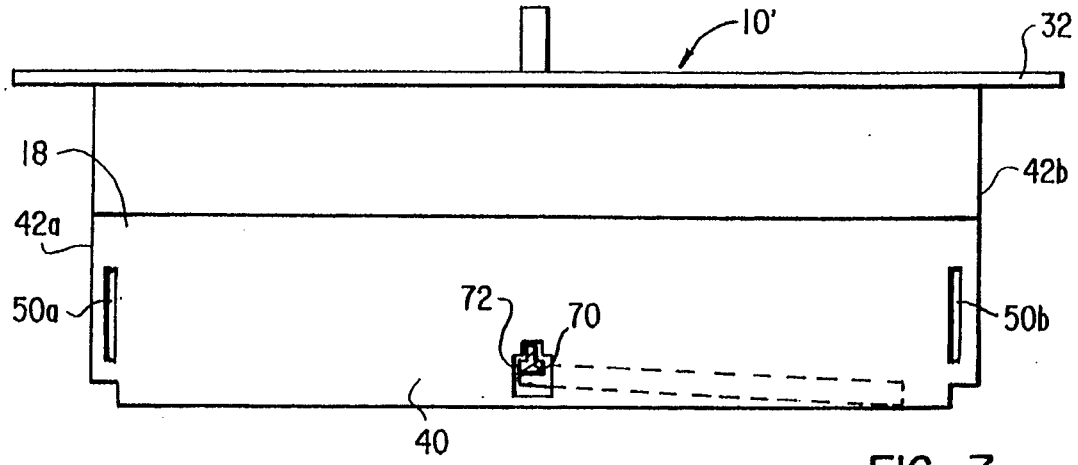
FIG. 7 is a front, partially-sectional, view taken on line VII—VII in FIG. 3, but with a top handle thereof being somewhat shorter than in the embodiment depicted in FIGS. 1 through 6 and being shown in a deployed mode in solid lines and in a stored mode in dashed lines.

The top handle 16 is molded separately from all of the other members as a single piece to have a U-shape with outwardly directed hooks 70 at ends of legs thereof. These hooks, when seen in cross-section, as can be seen in FIG. 7, are in inverted T-shapes with shanks of the Ts extending upwardly into narrow grooves of inverted key-hole openings 72 which are in the back wall 38 and the front wall 40 near the bottom wall 44. In this regard, the handle 16 can be pushed downwardly to disengage the shank, or webs, of the hooks 70 from the slots of the key-hole openings 72 so that the top handle 16 can be rotated downwardly to pivot in the key-hole opening 72. If the handle 16 is properly sized, it can be laid on the bottom wall 74 in the main cavity 20 as is depicted in dashed lines in FIG. 7.

All of the individual parts of the ladder caddy 10 are molded of a hard, resinous, break-resistant, plastic.

Describing now use of the ladder caddy shown in the drawings, the ladder caddy is constructed in a factory to have the general configuration shown in the drawings, preferably with the top handle 16 having a size such that it can lie down in the main cavity 20, as depicted in FIG. 7. Thus, the top handle 16, after having its hooks engaged in the key-hole openings 72, is placed in a lying configuration in the factory and a plurality of ladder caddies are nested together for transport. Naturally, when the ladder caddies are thusly transported, the follower arms 54*a* and *b* of the ladder-engaging handles 14 are receded into the track slots 48*a* and *b* as depicted in FIGS. 1 and 5 with the engaging link, or yoke bar, 60 being against the mounting side, or back wall, 38. A purchaser of a single ladder caddy rotates its top handle 16 to the position depicted in solid lines in FIGS. 1–7 where the shank, or web, of the hooks 70 is lifted up to be inserted into the upper slots of the key-hole openings 72. In this configuration, the user loads tools, and work things, into the various cavities 20–30 of the box portion 18 of the ladder caddy and also hangs tools, and other work things, in variously-shaped slots 76 of the flange 32. In this configuration, the user can carry and use the thusly-contained tools to various work sites using the top handle 16 during transportation, and supporting the ladder caddy 10 on any available support surface during use of the tools. In this regard, the ladder caddy serves as an excellent tool box.

Figure 6:
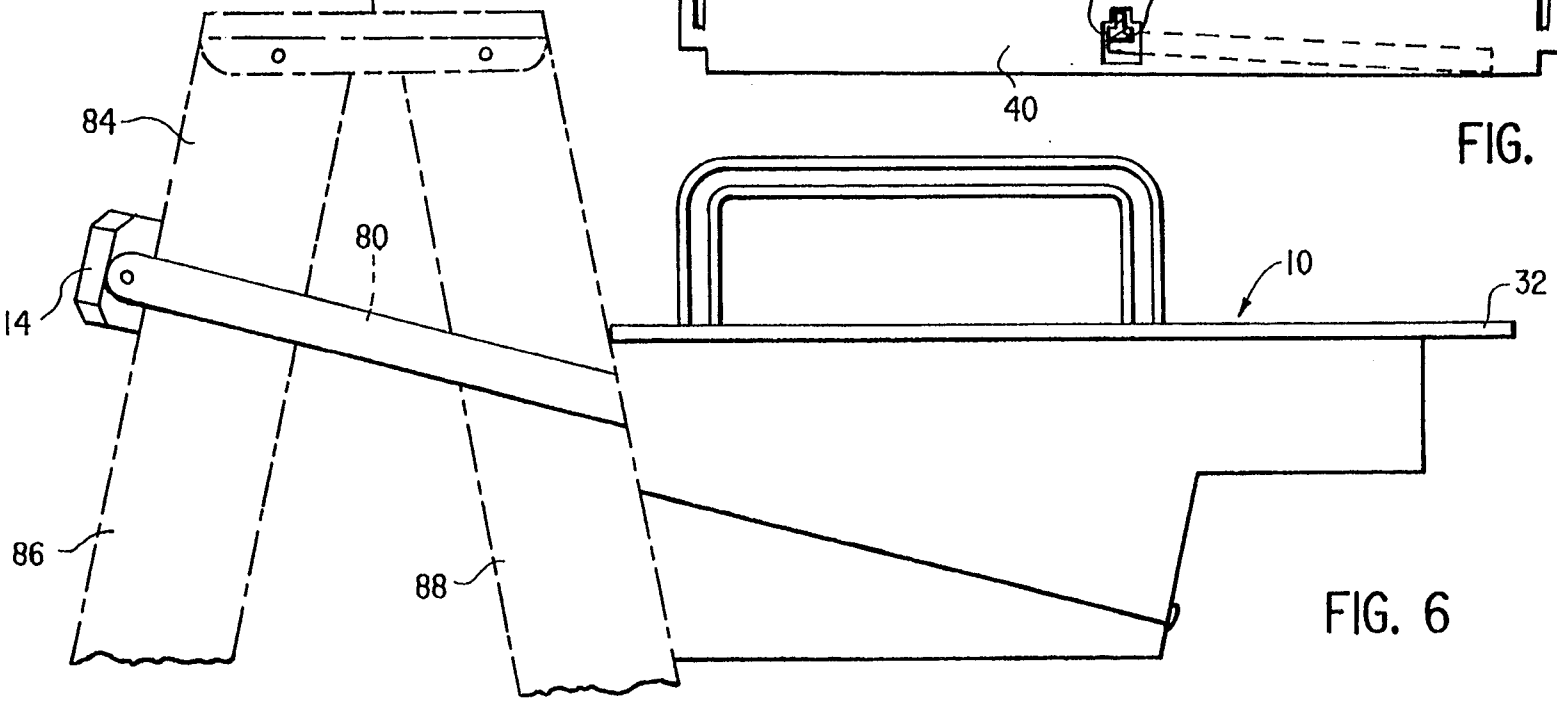
FIG. 6 is a side elevational view of the ladder caddy of FIG. 1, with a side ladder engaging handle being slid out to a deployed position and the ladder caddy being mounted on an A-frame ladder which is depicted in FIG. 6 in phantom.

However, when the user desires to use the ladder caddy 10 with an A-frame ladder 86, he pulls the engaging link, or yoke bar, 60 away from the back wall 38 so that the follower arms 54 slide out of the track slots 48*a* and *b* until the T-portions 58 of the follower arms 54*a* and *b* contact stop surfaces 78 in the track slots 48*a* and *b*, where the track slots 48*a* and *b* narrow at the back track-slot openings 52*a* and *b*. In this configuration, the ladder-engaging handle 14, including the yoke bar 60 and the two follower arms 54*a* and *b* and the back wall 38 of the box portion 18 define a rectangular mounting opening 80 which is of a size and shape for allowing passage therethrough of an apex 82 of the A-frame ladder 84 to pass therethrough. The rectangular mounting opening 80 is also sized and shaped so that, when the ladder's leg pairs are in a separated configuration for deploying the A-frame ladder for climbing, as is depicted in FIG. 6, portions of the leg pairs also pass through the rectangular mounting opening 80. However, the rectangular mounting opening 80 is sufficiently small that the ladder-engaging handle 14 and the back wall 38, or mounting side, when the ladder-engaging handle 14 is pulled out of the box portion 18 as far as it will go, contact the separated leg pairs of the A-frame ladder near the apex 82 thereof to prevent the separated legs from further passing through the mounting opening 88, whereby the ladder caddy remains mounted on the A-frame near the apex 82 thereof. The position of the ladder caddy 10 on the A-frame ladder 84 can be adjusted somewhat by rotating the yoke bar 60 to either bow toward the back wall, or mounting side, 38 or away from it, thereby making the mounting opening 80 smaller or larger. In this manner, the ladder caddy 10 can also be adjusted to some extent to fit various size ladders.

It will be understood by those of ordinary skill in the art that the ladder caddy of this invention, because of the various cavities it has, holds work things securely therein. Further, it will also be appreciated by those of ordinary skill in the art that the ladder caddy of this invention can be easily and quickly mounted on and removed from A-frame ladders for either moving the ladder or moving the tools from one place to another. Still further, the ladder caddy of this invention, since it is a separate member and shaped like a toolbox, could not be easily mistaken by a user for a shelf or a rung on which the user can stand, as can fold-out shelves of the prior art. It is also beneficial that the ladder caddy of this invention is sufficiently large that it can securely hold many different work things so that a user thereof can have the things he needs for performing work either at normal work sites or on A-frame ladders.

Further, it will also be appreciated by those of ordinary skill in the art that the various parts of the ladder caddy can be relatively easily and inexpensively molded and assembled.

While the invention has been particularly shown and described with reference to a preferred embodiment, it will be understood by those skilled in the art that various changes in form and detail may be made therein without departing from the spirit and scope of the invention.

The embodiments of the invention in which an exclusive property or privilege are claimed are defined as follows:

1. A ladder caddy for storing items to be portably carried about and to be selectively mounted on an A-frame ladder, said ladder caddy comprising:

a rigid tray having a top, a bottom, and sides, for defining an item-storing cavity for removably receiving items to be stored therein; and a ladder-engaging handle which is engaged to said rigid tray by an engagement means to extend laterally to a mounting side of said tray for defining with said rigid tray a generally rectangular mounting opening positioned laterally adjacent the mounting side of said tray, said mounting opening being of a size and shape for allowing passage therethrough of an apex of leg pairs of the A-frame ladder when the leg pairs are in a separated configuration for deploying the A-frame ladder for climbing, but is sufficiently small that the ladder-engaging handle and the rigid tray contact the separated legs of the A-frame ladder near the apex thereof to prevent the separated legs from further passing through the mounting opening, whereby the ladder caddy remains mounted on the A-frame ladder wherein said rigid tray defines two tracks and said ladder-engaging handle includes two follower arms slidably engage said tracks and a yoke bar for interconnecting said follower arms whereby said follower arms can be slid outwardly along said tracks for moving said yoke bar away from said rigid housing tray to a deployed position for forming said mounting opening.

2. A ladder caddy as in claim 1 wherein said tracks are slots in which said follower arms slide.

3. A ladder caddy as in claim 2 wherein said yoke bar is rotatably attached to said follower arms and said yoke bar has a bowed shape whereby the size of said rectangular mounting opening can be changed by rotating said yoke bar on said follower arms.

4. A laddercaddy as in claim 3 wherein said rigid tray defines a main cavity opening upwardly, and wherein is further included a top handle which is constructed as a separate piece, walls of said rigid tray defining said main cavity including openings in which hooks formed on said top handle engage.

5. A ladder caddy as in claim 4 wherein said hooks can rotate in said openings to lie in said main cavity close to a floor wall of said rigid tray.

6. A ladder caddy as in claim 2 wherein said rigid tray defines a main cavity opening upwardly, and wherein is further included a top handle which is constructed as a separate piece, walls of said rigid tray defining said main cavity including openings in which hooks formed on said top handle engage.

7. A ladder caddy as in claim 6 wherein said hooks can rotate in said openings to lie in said main cavity close to a floor wall of said rigid tray.

8. A ladder caddy as in claim 1 wherein said rigid tray defines a main cavity opening upwardly, and wherein is further included a top handle which is constructed as a separate piece, walls of said rigid tray defining said main cavity including openings in which hooks formed on said top handle engage.

9. A ladder caddy as in claim 8 wherein said hooks can rotate in said openings to lie in said main cavity close to a floor wall of said rigid tray.

10. A ladder caddy as in claim 1 wherein said rigid tray defines a main cavity opening upwardly, and wherein is further included a top handle which is constructed as a separate piece, walls of said rigid tray defining said main cavity including openings in which hooks formed on said top handle engage.

11. A ladder caddy as in claim 10 wherein said hooks can rotate in said openings to lie in said main cavity close to a floor wall of said rigid tray.

12. A ladder caddy. as in claim 1 wherein said yoke bar is rotatably attached to said follower arms and said yoke bar has a bowed shape whereby the size of said rectangular mounting opening can be changed by rotating said yoke bar on said follower arms.

13. A ladder caddy for storing items to be portably carried about and to be selectively mounted on an A-frame ladder, said ladder caddy comprising:

a rigid tray having a top, a bottom, and sides, for defining an item-storing cavity for removably receiving items to be stored therein; and a ladder-engaging handle which is engaged to said rigid tray by an engagement means to extend laterally to a mounting side of said tray for defining with said rigid tray a generally rectangular mounting opening positioned laterally adjacent the mounting side of said tray, said mounting opening being of a size and shape for allowing passage therethrough of an apex of leg pairs of the A-frame ladder when the leg pairs are in a separated configuration for deploying the A-frame ladder for climbing, but is sufficiently small that the ladder-engaging handle and the rigid tray contact the separated legs of the A-frame ladder near the apex thereof to prevent the separated legs from further passing through the mounting opening, whereby the ladder caddy remains mounted on the A-frame ladder;

wherein said rigid tray defines a main cavity opening upwardly, and wherein is further included a top handle which is constructed as a separate piece, walls of said rigid tray defining said main cavity including openings in which hooks formed on said top handle engage.

14. A ladder caddy as in claim 13 wherein said hooks can rotate in said openings to lie in said main cavity close to a floor wall of said rigid tray.

* * * * *